US007052374B1

(12) United States Patent
Lu et al.

(10) Patent No.: US 7,052,374 B1
(45) Date of Patent: May 30, 2006

(54) MULTIPURPOSE SLURRY DELIVERY ARM FOR CHEMICAL MECHANICAL POLISHING

(75) Inventors: Fang-lin Lu, Jhonghe (TW); Wen-chen Chien, Hsinchu (TW); Chia-cheng Chang, Daliao Township, Kaohsiung County (TW); Yung-wang Lo, Ji-an Township Hualien County (TW)

(73) Assignee: Taiwan Semiconductor Manufacturing Co., Ltd. (TW)

( * ) Notice: Subject to any disclaimer, the term of this patent is extended or adjusted under 35 U.S.C. 154(b) by 0 days.

(21) Appl. No.: 11/069,132

(22) Filed: Mar. 1, 2005

(51) Int. Cl.
*B24B 1/00* (2006.01)

(52) U.S. Cl. ..... 451/60

(58) Field of Classification Search ..... 451/5, 451/8, 60, 41; 438/691, 692
See application file for complete search history.

(56) References Cited

U.S. PATENT DOCUMENTS 5,804,507 A 9/1998 Perlov et al.
6,280,299 B1 8/2001 Kennedy et al.
6,348,124 B1 2/2002 Garbett et al.
6,398,627 B1 6/2002 Chiou et al.
6,410,441 B1 6/2002 Niu
6,482,290 B1 11/2002 Cheng et al.
2004/0198184 A1* 10/2004 Joslyn ..... 451/5
2004/0219867 A1* 11/2004 Gotkis et al. ..... 451/41
2005/0026549 A1* 2/2005 Maury et al. ..... 451/8
2005/0124267 A1* 6/2005 Jiang et al. ..... 451/60

* cited by examiner

*Primary Examiner*—Jacob K. Ackun, Jr.
(74) *Attorney, Agent, or Firm*—Duane Morris LLP

(57) ABSTRACT

An adjustable slurry dispensing device for use with a chemical mechanical polishing apparatus is disclosed. The slurry arm is pivotally connected to the polishing apparatus and has a slurry delivery assembly that is translatable along the length of the arm. This combination of adjustments allows the user to deposit polishing slurry at a desired location on the polishing pad of the polishing apparatus. The dispensing device may be motorized, in which case the slurry arm may be automatically pivotable and the slurry delivery assembly may be automatically translatable along the slurry arm. The motors may be controlled by a computer, or they may be manually adjusted by the user. A method of using the apparatus is also disclosed.

20 Claims, 8 Drawing Sheets

MULTIPURPOSE SLURRY DELIVERY ARM FOR CHEMICAL MECHANICAL POLISHING

FIELD OF THE INVENTION

The present invention relates to a method and apparatus for directing the deposition of polishing fluid onto a polishing platen as part of a chemical-mechanical polishing operation for semiconductor wafers.

BACKGROUND OF THE INVENTION

Apparatus for polishing thin, flat semi-conductor wafers is well known in the art. Such apparatus normally includes a polishing head which carries a membrane for engaging and forcing a semiconductor wafer against a wetted polishing surface, such as a polishing pad. Either the pad or the polishing head is rotated and oscillates the wafer over the polishing surface. The polishing head is forced downwardly onto the polishing surface by a pressurized air system or, similar arrangement. The downward force pressing the polishing head against the polishing surface can be adjusted as desired.

More recently, chemical-mechanical polishing (CMP) apparatus have been employed in combination with a pneumatically actuated polishing head. CMP apparatus are used primarily for polishing the front face or device side of a semiconductor wafer during the fabrication of semiconductor devices on the wafer. A wafer is "planarized" or smoothed one or more times during a fabrication process in order for the top surface of the wafer to be as flat as possible. A wafer is polished by being placed on a carrier and pressed face down onto a polishing pad covered with a slurry of colloidal silica or alumina in de-ionized water.

A perspective view of a typical CMP apparatus is shown in FIG. 1A. The CMP apparatus 10 consists of a controlled mini-environment 12 and a control panel section 14. In the controlled mini-environment 12, typically four spindles 16, 18, 20, and a fourth spindle, (not shown) are mounted on a cross-head 24. On the bottom of each spindle, for instance, under the spindle 16, a polishing head 26 is mounted and rotated by a motor (not shown). A substrate such as a wafer is mounted on the polishing head 26 with the surface to be polished mounted in a face-down position (not shown). During a polishing operation, the polishing head 26 is moved longitudinally along the spindle 16 in a linear motion across the surface of a polishing pad 28. As shown in FIG. 1A, the polishing pad 28 is mounted on a polishing disc 30 rotated by a motor (not shown) in a direction opposite to the rotational direction of the polishing head 26.

Also shown in FIG. 1A is a conditioner arm 32 which is equipped with a rotating conditioner disc 34. The conditioner arm 32 pivots on its base 36 for the in-situ conditioning of the pad 38 during polishing. While three stations, each equipped with a polishing pad 28, 38 and 40 are shown, the fourth station is a head clean load/unload (HCLU) station utilized for the loading and unloading of wafers into and out of the polishing head. After a wafer is mounted into a polishing head in the fourth head cleaning load/unload station, the cross head 24 rotates 90° clockwise to move the wafer just loaded into a polishing position, i.e., over the polishing pad 28. Simultaneously, a polished wafer mounted on spindle 20 is moved into the head clean load/unload station for unloading.

A cross-sectional view of a polishing station 42 is shown in FIG. 1B. As shown in FIG. 1B, a rotating polishing head 26 which holds a wafer 44 is pressed onto an oppositely rotating polishing pad 28 mounted on a polishing disc 30 by adhesive means. The polishing pad 28 is pressed against the wafer surface 46 at a predetermined pressure. During polishing, a slurry 48 is dispensed in droplets onto the surface of the polishing pad 28 to effectuate the chemical mechanical removal of materials from the wafer surface 46.

During a CMP process, a large volume of a slurry composition is dispensed. The slurry composition and the pressure applied between the wafer surface and the polishing pad determine the rate of polishing or material removal from the wafer surface. A slurry composition typically consists of an abrasive component, i.e, hard particles and components that chemically react with the surface of the substrate. For instance, a typical oxide polishing slurry composition consists of a colloidal suspension of oxide particles with an average size of 30 nm suspended in an alkali solution at a pH larger than 10.

The polishing pad 28 is a consumable item used in a semiconductor wafer fabrication process. Under normal wafer fabrication conditions, the polishing pad is replaced after about 12 hours of usage. Polishing pads may be hard, incompressible pads or soft pads. For oxide polishing, hard and stiffer pads are generally used to achieve planarity. Softer pads are generally used in other polishing processes to achieve improved uniformity and smooth surface. The hard pads and the soft pads may also be combined in an arrangement of stacked pads for customized applications.

Referring now to FIG. 2, a perspective view of a known CMP polishing station 42 is shown. The polishing station 42 includes a conditioning head 52, a polishing pad 28, and a slurry delivery arm 54 positioned over the polishing pad. The slurry delivery arm 54 is equipped with slurry dispensing nozzles 62 which are used for dispensing a slurry solution on the top surface 60 of the polishing pad 28. Surface grooves 64 are further provided in the top surface 60 to facilitate even distribution of the slurry solution and to help entrapping undesirable particles that are generated by coagulated slurry solution or any other foreign particles which have fallen on top of the polishing pad during a polishing process. The surface grooves 64, while serving an important function of distributing the slurry, also presents a processing problem when the pad surface 60 gradually wears out after successive use.

The slurry delivery arm 54 shown in FIG. 2 delivers a slurry solution to the polishing pad 28 in a stationary manner. The distribution of the slurry solution over the top surface of the polishing pad depends on the rotation of the pad. Since the slurry solution is usually dispensed at the center of the polishing platen, i.e., at the center of the polishing pad, it is difficult to evenly spread the slurry solution over the pad surface by the rotation of the pad. As a result, the amount of slurry at the edge of the polishing pad is always less than that in the center region of the pad. This leads to a higher removal rate at the center of the pad when compared to the edge portion of the pad. And furthermore, a higher polishing noise level is made during the polishing process. The problem is more severe with newly designed polishing pads which have deeper surface grooves than older pads, and thus it becomes more difficult to spread the slurry solution uniformly on the polishing pad.

SUMMARY OF THE INVENTION

An adjustable fluid dispenser is disclosed for a polishing apparatus having a polishing pad. The dispenser comprises an adjustable fluid delivery arm having first and second ends and a length. The first end of the arm is pivotally engaged with the polishing apparatus so that the second end of the arm may be adjustably positioned over at least a portion of the polishing pad. The dispenser further comprises a fluid delivery assembly for dispensing a fluid onto the polishing pad. The fluid delivery assembly is associated with the fluid delivery arm such that moving the arm moves the assembly. The fluid delivery assembly is further configured to be selectively translatable along at least a portion of the length of the fluid delivery arm to allow a user to deliver fluid to a desired portion of the polishing pad.

BRIEF DESCRIPTION OF THE DRAWINGS

These and other features and advantages of the present invention will be more fully disclosed in, or rendered obvious by, the following detailed description of the preferred embodiment of the invention, which is to be considered together with the accompanying drawings wherein like numbers refer to like parts, and further wherein.

DETAILED DESCRIPTION

According to an embodiment of the present invention, disclosed herein is an adjustable slurry arm for use in a chemical mechanical polishing (CMP) system. Specifically, the first example discloses an adjustable slurry dispensing device for use in a chemical mechanical polishing apparatus that is capable of spreading a slurry solution on top of a polishing pad in a substantially more uniform manner than slurry dispensing arms used in conventional chemical mechanical polishing apparatus.

Figure 1A:
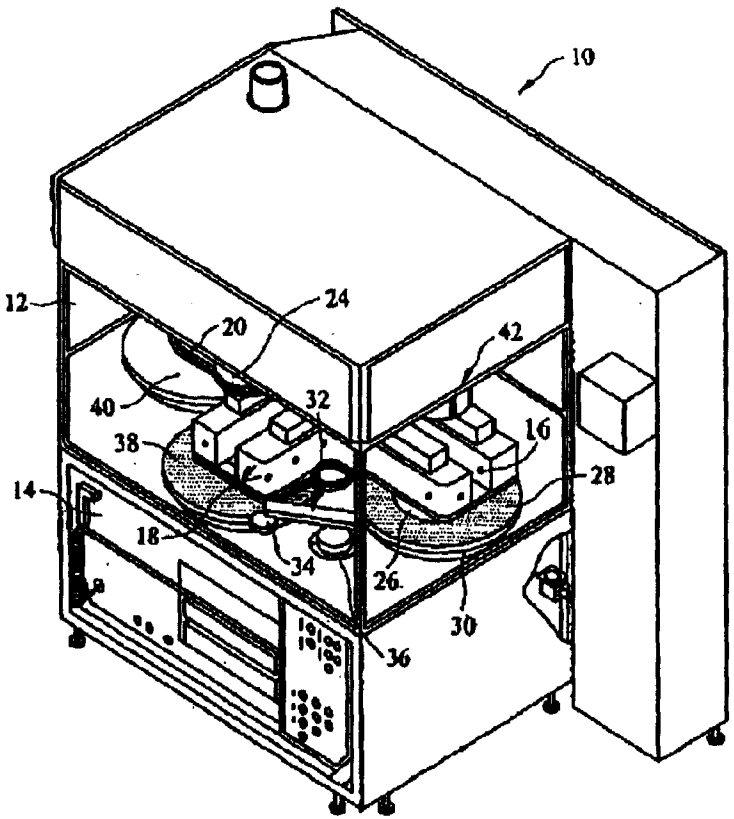
Fig. 1A (Prior Art)
FIG. 1A is a perspective view of a conventional chemical-mechanical polishing (CMP) apparatus illustrating multiple polishing stations.
Figure 1B:
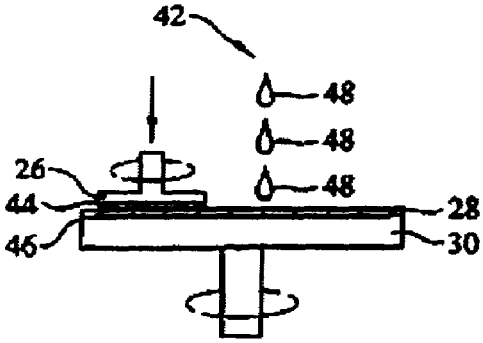
Fig. 1B (Prior Art)
FIG. 1B is a cross-sectional view of a polishing head and a polishing platen engaged together with a wafer therebetween.
Figure 2:
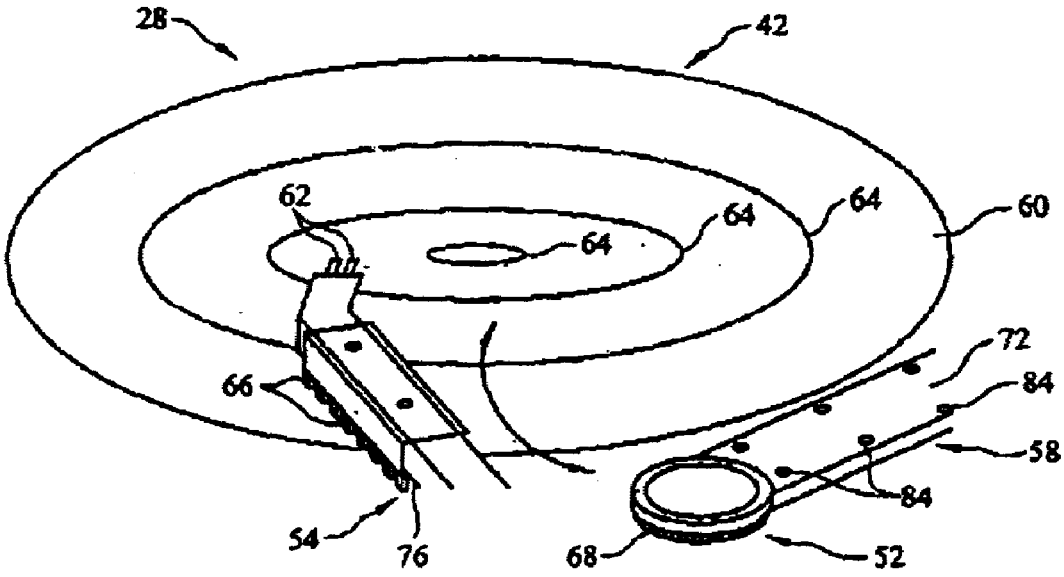
Fig. 2 (Prior Art)
FIG. 2 is a perspective view of a polishing pad with a stationary slurry dispensing arm in a conventional CMP apparatus.
Figure 3:
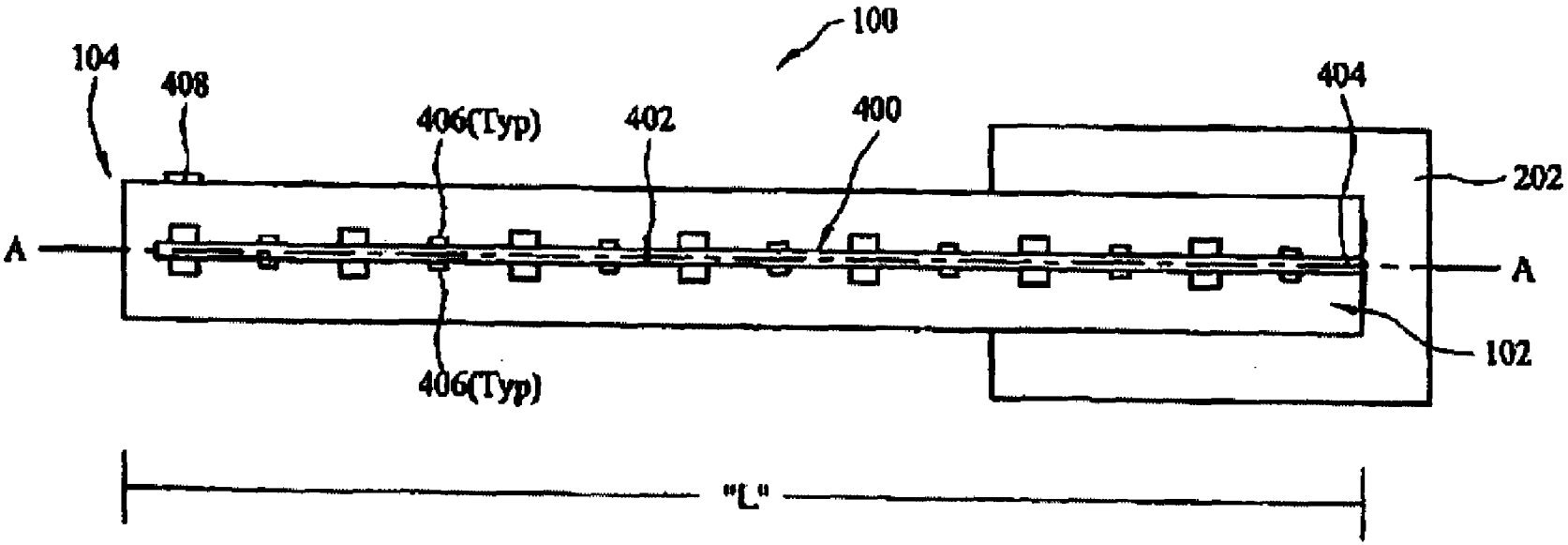
FIG. 3 is a plan view of the adjustable slurry arm of the present invention.
Figure 4:
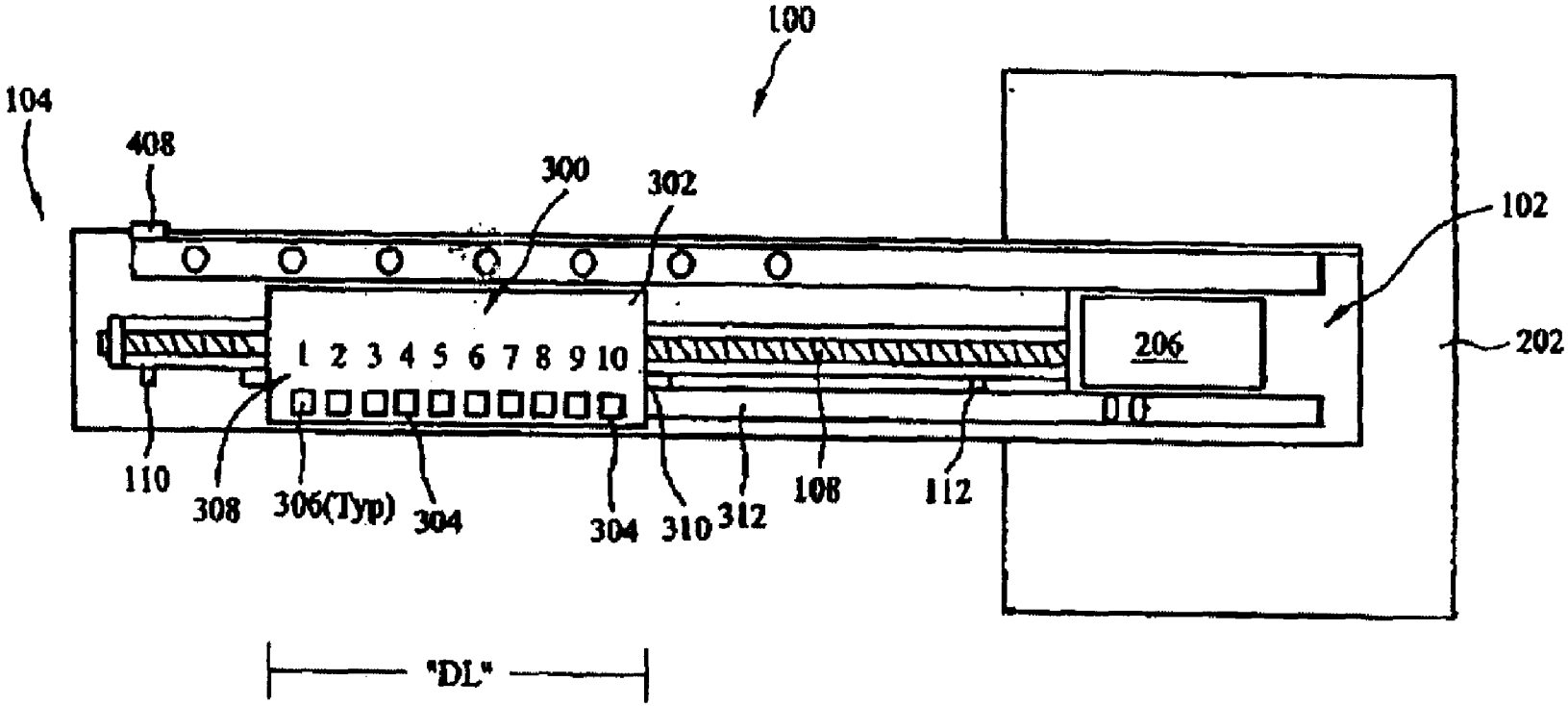
FIG. 4 is a cut-away plan view of the adjustable slurry arm of FIG. 3.

As illustrated in FIGS. 3 and 4, slurry arm 100 may have first and second ends 102, 104, a length "L" and a longitudinal axis A—A. The first end 102 may engage a motor base portion 202 of a chemical mechanical polishing (CMP) platform 200 (FIG. 5), while the second end 104 may be positionable over a semiconductor wafer polishing pad 204 that is part of the CMP platform 200. A fluid delivery assembly 300 comprising one or more fluid delivery nozzles 302 may be mounted on the arm 100 and may be movable with respect to the arm along its longitudinal axis A—A so as to allow the position of the nozzles to be adjustable with respect to the arm. In one embodiment, the fluid delivery assembly 300 is configured to direct a flow of polishing slurry to the polishing pad 204 and the translational movement of the assembly 300 with respect to the arm 100 may allow slurry to be directed to a specific location on the polishing pad 204 that is in line with the slurry arm 100. For an added measure of adjustability, the first end 102 of the arm 100 may be pivotally connected to the motor base portion 202 to allow pivoting movement of the arm 100 with respect to the CMP platform 200. This "sweep" adjustability, in combination with the aforementioned translational adjustability of the fluid delivery assembly, allows the user to position the delivery nozzles 304 at a wide variety of locations over the polishing pad 204 to optimize the wafer polishing process. Either or both of the adjustments may be motorized, and either may be manually or computer controlled, as will be discussed in greater detail below.

The slurry delivery arm 100 may further have a housing 106 that contains the fluid delivery assembly 300. The housing 106 may be provided with a flushing system 400 to prevent slurry buildup therein, thus reducing the possibility that accumulated dry slurry could fall onto the polishing pad 204 and scratch a wafer undergoing polishing. Further details of the flushing system will be provided below.

Referring again to FIGS. 3 and 4, the slurry arm 100 may be pivotally connected to the motor base portion 202 of the CMP platform 200 to allow "sweep," movement of the slurry arm with respect to the platform (and thus the polishing pad 204). In one embodiment, the slurry arm 100 may have a pivoting range, or "sweep" range, of about 120 degrees to facilitate enhanced slurry coverage for a wide range of wafer diameters. This "sweep" movement may be controlled using a motor 206 disposed within the motor base portion 202 of the CMP platform 200. A worm gear assembly 208 may be used to operably connect the sweep control motor 206 to the slurry arm 100, to translate the relatively high output speed of the motor to a lower desired sweep speed of the arm 100. The sweep control motor itself may be controlled by a computer provided as part of the CMP platform 200.

The slurry arm 100 may have a housing 106 within which the fluid delivery assembly 300 is disposed. The fluid delivery assembly 300 may be linearly movable within the housing 106 along (or substantially parallel to) the axis A—A of the arm 100 to allow the position of the slurry delivery nozzles 304 to be adjusted along the arm. To achieve this linear adjustment, a threaded drive rod 108 may be disposed along at least a portion of the length "L" of the arm 100, and may be oriented substantially parallel to the axis A—A. The drive rod 108 may threadably engage an internally threaded portion (not shown) of the fluid delivery assembly 300, such that when the drive rod 108 is rotated the fluid delivery assembly 300 (and delivery nozzles 304) translate along the rod in the desired direction. Like the sweep movement, this "translational" movement may be controlled using a motor disposed at the first end of the slurry arm 100. This translation motor also may be controlled by the computer.

Figure 6:
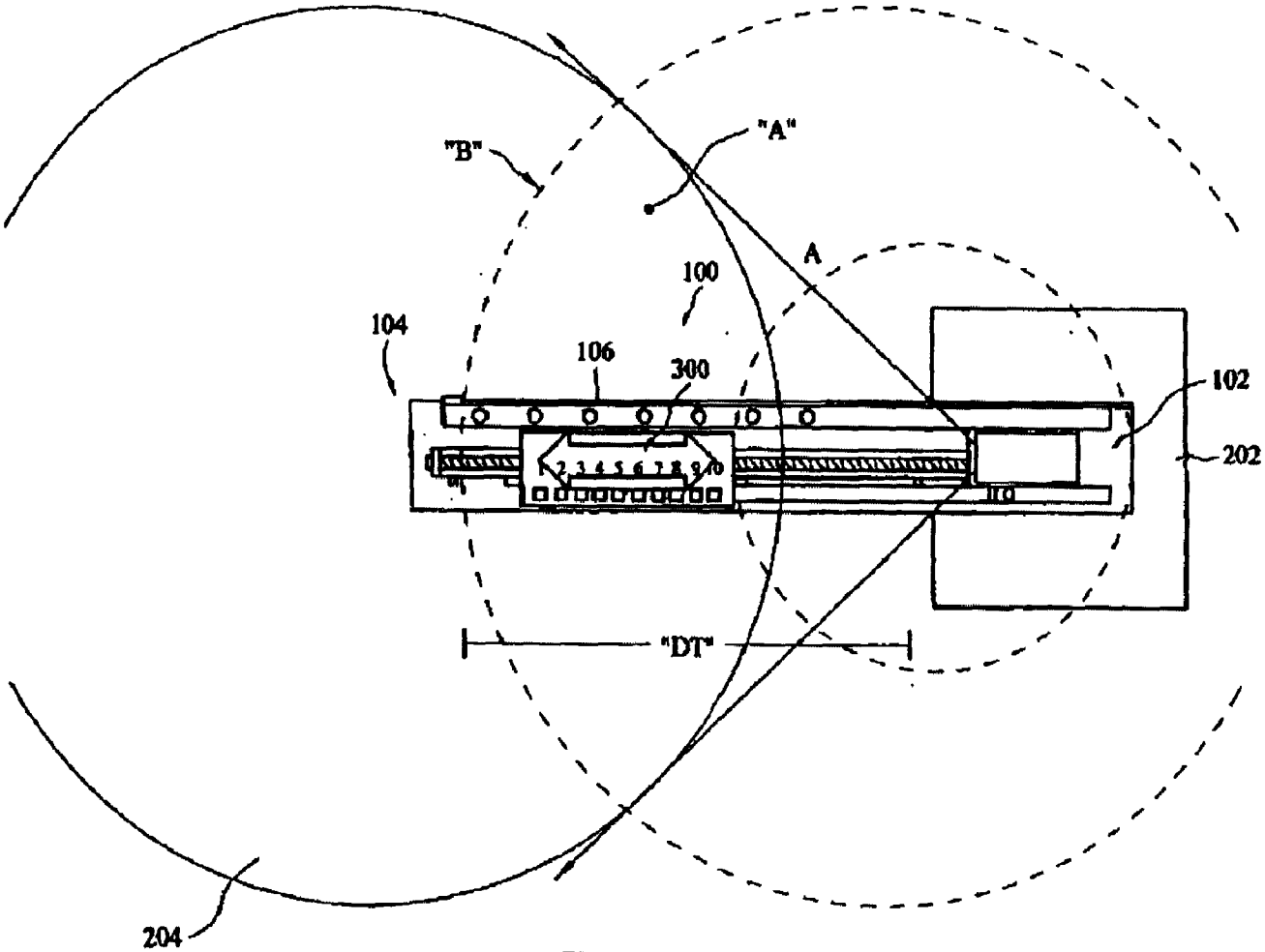
FIG. 6 is a plan view of the semiconductor wafer polishing apparatus illustrating the range of translation and sweeping motion of the adjustable slurry arm of FIG. 3.

To prevent damage to the system components such as the translation motor, slurry arm 100 and the wafer undergoing polishing, a pair of stop elements 110, 112 may be provided on the slurry arm 100 to prevent the fluid delivery assembly 300 from traveling beyond a certain predetermined range. These stop elements 110, 112 may assume any desired geometry (e.g., raised pins, rings, etc.) appropriate to engage a respective end surface 308, 310 of the fluid delivery assembly 300. As illustrated in FIG. 6, the delivery assembly can translate along the slurry arm 100 by a distance "DT," which in one embodiment is about 50 cm.

The fluid delivery assembly 300 has an elongated body portion 302 with a length "DL," and a plurality of recesses 306 disposed along at least a portion of the length. Each of the recesses 306 is configured to selectively engage and retain a single fluid delivery nozzle 304 to orient the nozzle 304 to deliver slurry to the polishing pad 204 during operation. The assembly 300 and recesses 306 are configured to make it easy for a user to engage a nozzle 304 within a selected recess 306. Providing multiple recesses 306 and multiple nozzles 304 provides yet another mode of adjustability for providing slurry to the polishing pad 204. A user can select a particular recess 306 to receive a nozzle 304 based on the specific polishing process to be performed, and/or the individual wafer size and film profile encountered (i.e. center high, center low).

Slurry is provided to each of the delivery nozzles 304 via at least one slurry delivery tube 312. Each tube 312 is connected at one end to the slurry delivery nozzles 304 and at the opposite end to a source of slurry material located within the CMP platform 200. To accommodate the translational movement of the fluid delivery assembly 300, the tube may be flexible so as to be linearly expandable and compressible (e.g. they may have an accordion shape). Alternatively, the tube 312 may be resiliently biased toward the CMP platform 200 to provide a variable extension length to match the position of the fluid delivery assembly 300. Thus, the tube may extend out from the CMP platform 200 when the fluid delivery assembly 300 translates toward the second end of the slurry delivery arm 100, then retract back into the platform 200 when the fluid delivery assembly 300 translates back toward the first end of the slurry arm 100.

In the embodiment illustrated in FIG. 4, the fluid delivery assembly 300 has two fluid delivery nozzles 304 and ten separate recesses 306 disposed linearly along the length "DL" of the assembly 300 to provide a multiplicity of placement locations for the nozzles. It is noted that the number of nozzles and recesses is not critical and more or less of each may be provided without departing from the spirit of the invention. Likewise, adjacent recesses 306 may be spaced at any appropriate distance from each other to provide the desired adjustability of the nozzles 304 along the assembly 300.

The fluid delivery nozzles 304 may each have a fixed opening (i.e. non-adjustable) sized to provide a desired slurry dispensing rate in the range of about 50 ml/sec. to about 500 ml/sec. Alternatively, the nozzles may each be equipped with an adjustable flow control valve, such that the flow rate of the slurry solution through the nozzle openings can be individually manually adjusted within a suitable range. In one embodiment, the adjustable nozzles provide a slurry dispensing rate of from about 50 ml/sec. to about 500 ml/sec. The nozzles 304 may also be pivotable within the recesses 306 to allow the user to control the individual dispensing direction for each nozzle 304. This pivoting may be controlled manually by the user, or by providing individual pivot control motors (e.g. electric servo or other appropriate motor) within the dispensing assembly 304. Where pivot control motors are provided, they may be controlled by the computer. In one embodiment, the nozzles 304 will be fixed in pitch and position (within a respective recess) as desired by the user. The motors that control arm movement are controlled by system software and tailored for a specific process recipe. The motors also can provide feedback to the computer (e.g. stepping count, torque, etc.) to provide confirmation to the system that the desired movement is properly occurring.

Figure 5:
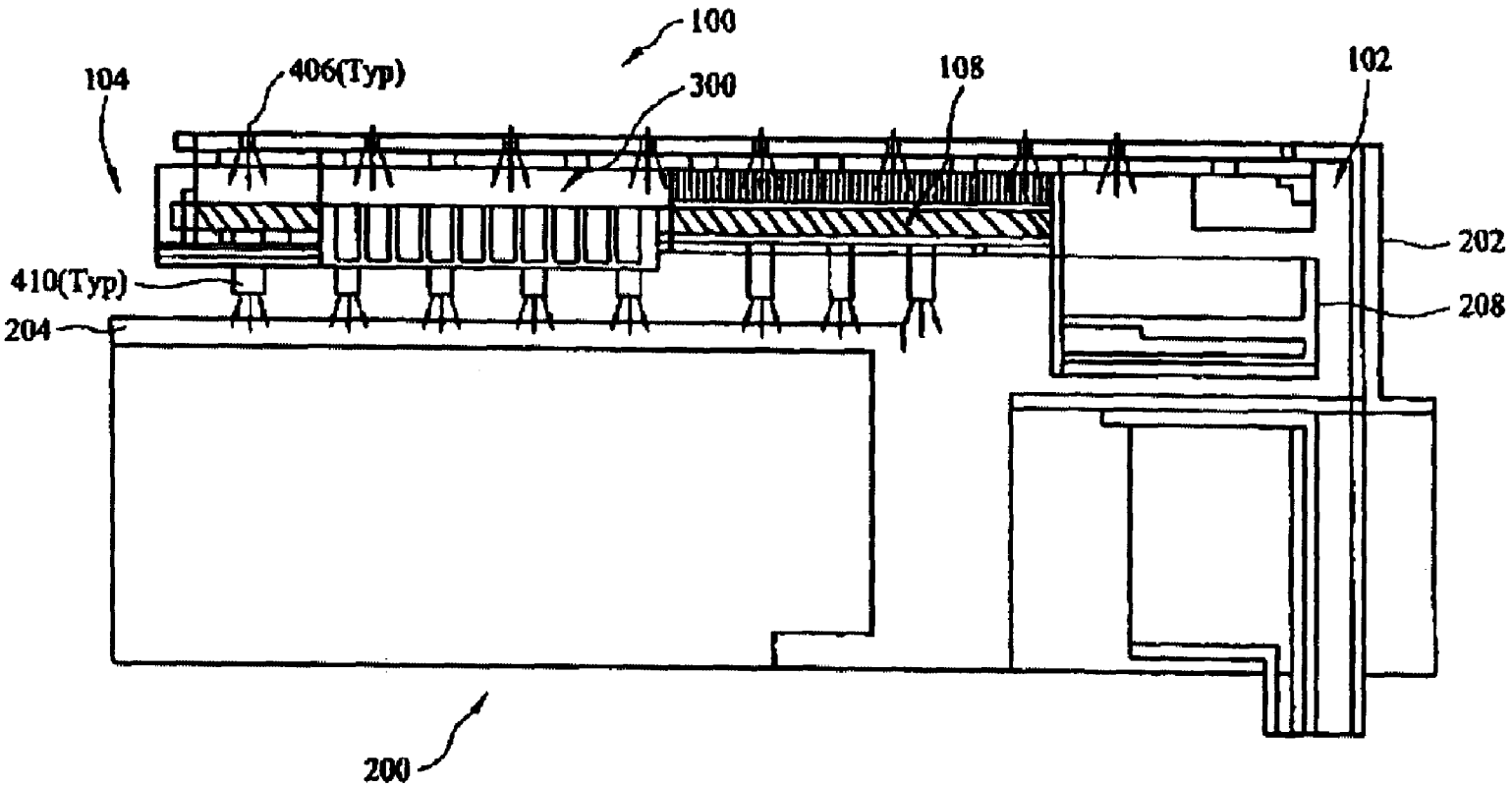
FIG. 5 is a side view of a semiconductor wafer polishing apparatus incorporating the adjustable slurry arm of FIG. 3, illustrating the apparatus in flushing mode.
Figure 8:
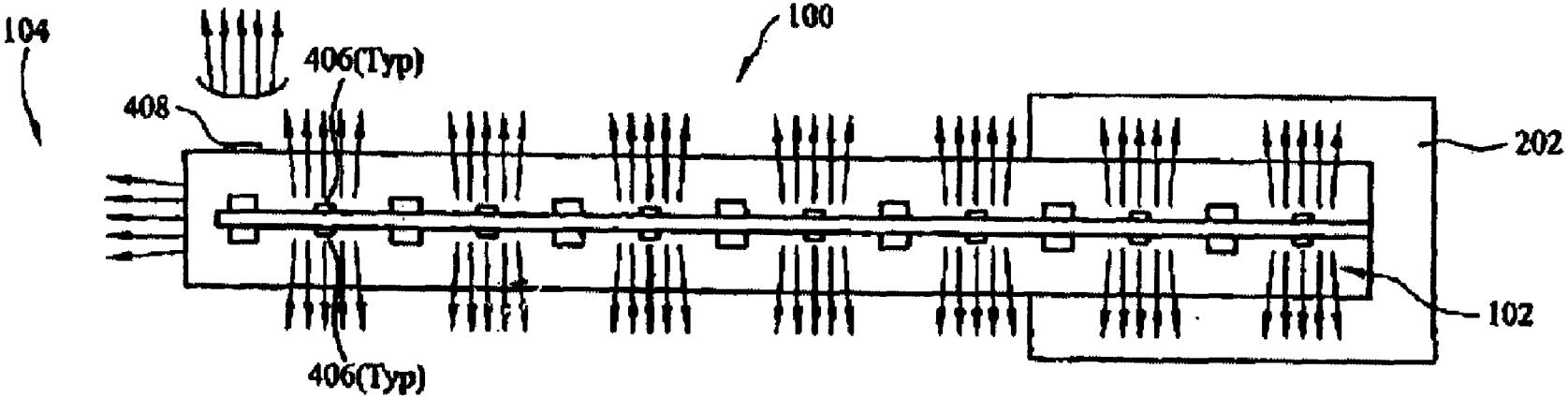
FIG. 8 is a plan view of the slurry arm of FIG. 3, further illustrating the apparatus in flushing mode.

As illustrated in FIGS. 3, 5 and 8, the slurry arm 100 may further have a flushing system 400 disposed within the arm housing 106. This flushing assembly may be used subsequent to a CMP polishing operation to prevent the buildup of slurry within the housing, thus reducing the possibility that accumulations of dried slurry could fall onto the polishing pad 204 and scratch a wafer that is being polishing.

The flushing system 400 may have a flushing tube 402 disposed along at least a portion of the length of the arm 100 within the housing 106. The tube 402 may have a first end 404 connected to a source of deionized water (DIW), and a plurality of flushing nozzles 406 located along the length of the tube 402. The DIW source may be located within the CMP platform 200 or alternatively, the DIW may be provided from an external source. The flushing nozzles 406 may be sized and positioned as appropriate to provide a desired flow of DIW to flush accumulated deposits of slurry material from the interior of the housing 106. Some or all of the flushing nozzles 406 also may be individually adjustable for position and flow rate, to allow the user to change the flushing pattern as desired. In the illustrated embodiment, 16 flushing nozzles are provided for the housing, although more or fewer nozzles may be provided. In one embodiment, the nozzles 406 can provide an adjustable flow of from about 50 ml/sec. to about 500 ml/sec. to housing 106.

Figure 7A:
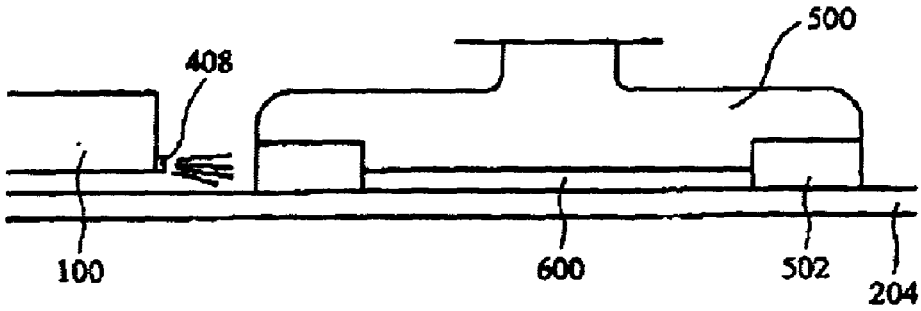
FIG. 7*a* is a side view of the slurry arm of FIG. 3 applying flushing water to a portion of a wafer polishing head.
Figure 7B:
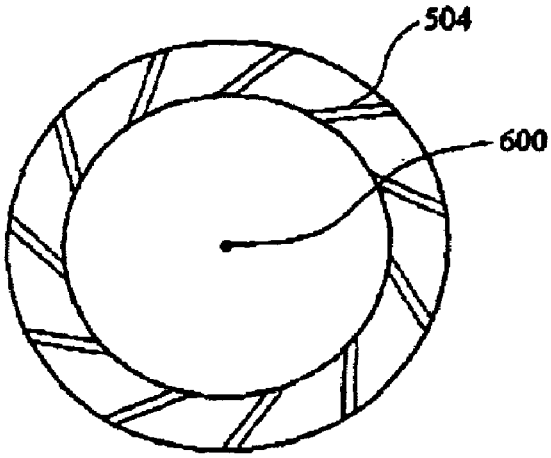
FIG. 7*b* is a plan view of a wafer polishing head with a head retain ring.

A separate DIW nozzle 408 may be provided at the second end 104 of the slurry arm 100, external to the housing 106, to provide a flow of DIW to flush the head retain ring 502 (FIGS. 7A, B) of the CMP polishing head 500. The head retain ring 502 is used to retain a wafer 600 on the CMP polishing head 500 during the polishing process. The ring 502 has grooves 504 through which the slurry flows during the polishing process. Like the housing 106, the head retain ring 502 should be thoroughly rinsed after polishing to eliminate accumulations of slurry which, when dry, can scratch a wafer during subsequent polishing. In the illustrated embodiment, nozzle 408 is arranged on one lateral side of the slurry arm 100 to provide a laterally disposed flow of water (FIG. 7A) to the head retain ring 502. Like the housing flush DIW nozzles 406, the head retain ring DIW nozzle 408 may be adjustable for position and flow rate. In one embodiment, the nozzle 408 can provide an adjustable flow of from about 50 ml/sec. to about 500 ml/sec. to the head retain ring 502.

Similarly, as illustrated in FIG. 5, one or more DIW nozzles 410 may be disposed along at least a portion of the length of the slurry arm 100 to provide high pressure flushing of the CMP polishing pad 204. Proper flushing of the polishing pad 204 after use can increase the life of the pad, and thus reduce overall process costs, as well as reduce the chance for scratching a wafer during subsequent polishing. These flushing nozzles 410 may have the flow rate and directional adjustment features of the previously described nozzles 406, 408, and may provide flushing water to the CMP polishing pad 204 at a flow rate in the range of about 50 ml/sec. to about 500 ml/sec.

FIG. 6 illustrates the range of motion of the slurry arm 100 in which the previously described sweeping and translating motion allows deposition of slurry on the polishing pad 204 at any location within the region "A," where region "A" represents the area of overlap between the polishing pad 204 and the total range of sweeping and translating motion allowed by the slurry arm 100 and fluid delivery assembly 300.

Actuating the sweep control motor 206 causes the slurry dispensing nozzles 304 to sweep across the polishing pad 204 in concentric arcuate paths having radii equal to the distance between each nozzle and the connection point of the arm 100 and the motor base portion 202. Thus, slurry solution is dispensed along these arcuate paths onto the top surface of the polishing pad 204. Actuating the translation control motor causes the slurry dispensing nozzles 304 to move linearly along the slurry delivery arm 100, and the slurry solution is dispensed linearly across the top of the polishing pad 204. As will be apparent to one of ordinary skill in the art, actuating both motors at the same time will allow the user to position the slurry dispensing nozzles 304 over any desired location within region "A," thus allowing the slurry deposition process to be customized for wafer size, film type, and user preference.

The translation motor can be configured to provide translation speeds of from about 1 mm/sec to about 50 mm/sec, and preferably are about 50 mm/sec.

During preventive maintenance evolutions, the user may wish to pivot the slurry arm 100 away from the polishing pad so that the arm does not interfere with operations such as replacement of a polishing pad, or other maintenance procedure. After such maintenance, it is important that the slurry arm 100 be repositioned over the polishing pad 204 to ensure that slurry is properly applied during the next subsequent polishing operation. Thus, the CMP platform 200 can be provided with a position interlock sensor that senses when the slurry arm 100 is positioned in the preventive maintenance mode (i.e. pivoted away from the polishing pad). If a user attempts to operate the CMP platform 200 to polish a wafer while the slurry arm 100 is in the preventive maintenance mode, the interlock sensor will sound an alarm (audio, visual or other), and may also prevent the slurry from being supplied to the slurry nozzles 304.

Any or all of the motors controlling the slurry arm sweep and translation, slurry nozzle flow rate and position motors, as well as the motors controlling the flow rate and position of the DIW nozzles 406, 408, 410 for flushing the housing 106, the head retain ring 504, and the polishing pad 204 can be controlled by a central computer provided as part of or separate from the CMP platform 200. The computer may be programmed to automatically control the associated motors according to a pre-determined set of parameters, such as the type of polishing process taking place, the size of the wafer being processed, or other appropriate criteria.

The computer can also be programmed to limit the total sweep and translation ranges for the slurry arm 100 and fluid delivery assembly 300 and to provide an alarm signal (audible, visual or other) when maximum range values are being approached, met and/or exceeded. The computer also can be programmed to stop the motors when the sweep and translation range maximum values are encountered. Alternatively, the user may manually operate the computer either before or during the polishing process to control any or all of the motors individually or as a unit to provide desired slurry deposition and flushing water control to suit the individual application.

While the foregoing invention has been described with reference to the above embodiments, various modifications and changes can be made without departing from the spirit of the invention. Accordingly, all such modifications and changes are considered to be within the scope and range of equivalents of the appended claims.

The invention claimed is:

1. An adjustable fluid dispenser for a polishing apparatus, the dispenser comprising:

an adjustable fluid delivery arm having first and second ends and a length, the first end pivotally engaged with the polishing apparatus so that the second end is adjustably positionable over at least a portion of a polishing pad;

at least one fluid delivery assembly for dispensing a fluid onto the polishing pad, the fluid delivery assembly associated with the fluid delivery arm such that moving the arm moves the assembly; the fluid delivery assembly further comprising a housing and a housing flushing assembly for flushing accumulated slurry from a portion of said housing;

wherein the fluid delivery assembly is configured to be selectively translatable along at least a portion of the length of the fluid delivery arm to deliver fluid to a desired portion of the polishing pad.

2. The adjustable fluid dispenser of claim 1, wherein the fluid delivery arm further comprises a lead screw and the fluid delivery assembly further comprises internal threads configured to threadably engage the lead screw such that relative rotation between the lead screw and the internal threads of the fluid delivery assembly causes the fluid delivery assembly to translate along the fluid delivery arm.

3. The adjustable fluid dispenser of claim 2, further comprising sweep control and translation control motors, the sweep control motor coupled to the first end of the fluid delivery arm to allow automated pivoting of the arm with respect to the polishing pad, the translation control motor configured to provide automated translation control of the fluid delivery assembly along the fluid delivery arm by controlling a relative rotation between said lead screw and said internal threads of said fluid delivery assembly.

4. The adjustable fluid dispenser of claim 3, further comprising a computer associated with the sweep control and translation control motors for controlling the position of the fluid delivery assembly with respect to the polishing pad.

5. The adjustable fluid dispenser of claim 1, wherein the fluid delivery assembly comprises a slurry delivery tube for conducting slurry from the polishing apparatus to the fluid delivery assembly, the slurry delivery tube having a fluid delivery nozzle, the fluid delivery assembly further having a plurality of nozzle positioning recesses arranged along a longitudinal axis of the assembly, the delivery nozzle being selectively positionable within one of the recesses.

6. The adjustable fluid dispenser of claim 5, wherein the dispenser has two slurry delivery tubes for conducting slurry from the polishing apparatus to the fluid delivery assembly, each tube having an associated delivery nozzle that is adjustably positionable within a respective nozzle positioning recess.

7. The adjustable fluid dispenser of claim 5, wherein the delivery nozzle has an adjustable slurry delivery opening to allow the user to selectively adjust the direction of the flow of slurry onto the polishing pad.

8. The adjustable fluid dispenser of claim 1, wherein the housing flushing assembly further comprises a tube having a plurality of flushing nozzles disposed along at least a portion of the tube to flush the housing after using the arm for slurry deposition.

9. The adjustable fluid dispenser of claim 8, wherein the flushing assembly further comprises at least one head retain ring flushing nozzle for directing flushing fluid at a head retain ring of the polishing apparatus to clean the head retain ring subsequent to a polishing operation.

10. An adjustable slurry arm for a polishing apparatus, the dispenser comprising:

an adjustable arm having first and second ends and a length, the first end pivotally engaged with the polishing apparatus and the second end positionable over at least a portion of a polishing pad;

at least one adjustable slurry nozzle assembly for dispensing polishing slurry onto the polishing pad, the nozzle assembly having at least one slurry delivery nozzle for directing polishing slurry to the polishing pad, the nozzle assembly being mounted on the adjustable arm, the nozzle assembly further comprising a plurality of nozzle positioning recesses arranged along a longitudinal axis of the slurry nozzle assembly, the slurry delivery nozzle being selectively positionable with respect to one of the recesses;

wherein the slurry nozzle assembly is selectively translatable along at least a portion of the length of the adjustable arm to direct polishing slurry to a selected portion of the polishing pad.

11. The adjustable slurry arm of claim 10, wherein the fluid delivery arm further comprises a lead screw and the slurry nozzle assembly further comprises internal threads configured to threadably engage the lead screw such that relative rotation between the lead screw and the internal threads of the slurry nozzle assembly causes the slurry nozzle assembly to translate along the adjustable arm.

12. The adjustable slurry arm of claim 11, further comprising sweep and translation control motors, the sweep control motor coupled to the first end of the adjustable arm to allow automated pivoting of the arm with respect to the polishing pad, and the translation control motor configured to provide automated translation control of the slurry nozzle assembly along the adjustable arm by controlling a relative rotation between said lead screw and said internal threads of said slurry nozzle assembly.

13. The adjustable slurry arm of claim 12, further comprising a computer associated with the sweep control and translation control motors for controlling the position of the slurry nozzle assembly with respect to the polishing platen.

14. The adjustable slurry arm of claim 10, wherein the slurry delivery nozzle is pivotably positionable with respect to at least one of said plurality of nozzle positioning recesses to allow the user to control the dispensing direction of the nozzle.

15. The adjustable slurry arm of claim 14, wherein the slurry nozzle assembly has two slurry delivery tubes for conducting slurry from the polishing apparatus to the slurry nozzle assembly, each tube having an associated delivery nozzle that is adjustably positionable within a respective nozzle positioning recess.

16. The adjustable slurry arm of claim 14, wherein the slurry delivery nozzles has an adjustable slurry delivery opening to allow the user to selectively adjust a volume of the flow of slurry onto the polishing pad.

17. The adjustable slurry arm of claim 10, wherein the slurry arm further comprises a housing within which the adjustable slurry nozzle assembly is located, the housing further having a flushing assembly disposed within at least a portion of the housing, the flushing assembly comprising a tube having a plurality of flushing nozzles disposed along at least a portion of the tube length to flush the housing after using the arm for slurry deposition.

18. The adjustable slurry arm of claim 17, wherein at least one of the flushing nozzles is adjustable to allow the user to selectively adjust the direction of the flow of flushing water within the housing.

19. A method of adjustably dispensing slurry to a work surface of a polishing apparatus, comprising the steps of:

(a) providing a chemical-mechanical polishing (CMP) apparatus having an adjustable slurry delivery arm for directing polishing slurry onto a polishing pad, the adjustable slurry delivery arm comprising an arm member with a slurry delivery unit movably mounted thereon, the arm member adapted to be pivoted;

(b) adjusting one of the group consisting of a pivot angle of the arm member and the position of the slurry delivery unit along the arm member, to direct polishing slurry onto a selected portion of the polishing pad;

wherein said step of adjusting comprises one of (i) adjusting said pivot angle using a worm gear assembly and (ii) adjusting the position of the slurry delivery unit using a lead screw assembly.

20. The method of claim 19, the CMP apparatus further comprising sweep and translation control motors, the sweep control motor being associated with the elongated arm member for controlling the pivoting movement of the arm with respect to the base, and the translation control motor configured to provide automated translation control of the slurry nozzle assembly along the adjustable arm; wherein the CMT apparatus further comprises a computer associated with the sweep control and translation control motors; the method comprising the additional step of operating the computer to control the position of the slurry delivery unit with respect to the polishing pad.

* * * * *

UNITED STATES PATENT AND TRADEMARK OFFICE

CERTIFICATE OF CORRECTION

PATENT NO. : 7,052,374 B1
APPLICATION NO. : 11/069132
DATED : May 30, 2006
INVENTOR(S) : Fang-lin Lu et al.

It is certified that error appears in the above-identified patent and that said Letters Patent is hereby corrected as shown below:

Column 10, line 44, delete “CMT” and insert therefore -- CMP --.

Signed and Sealed this

Twenty-fourth Day of July, 2007

JON W. DUDAS
*Director of the United States Patent and Trademark Office*